US007435120B2

(12) United States Patent
Jänicke et al.

(10) Patent No.: US 7,435,120 B2
(45) Date of Patent: Oct. 14, 2008

(54) ELECTRICAL INSULATOR, ESPECIALLY FOR MEDIUM AND HIGH VOLTAGES

(75) Inventors: Lutz-Rüdiger Jänicke, Mahlow (DE); Nils Werning, Berlin (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 11/578,597

(22) PCT Filed: Mar. 24, 2005

(86) PCT No.: PCT/DE2005/000562

§ 371 (c)(1),
(2), (4) Date: Nov. 3, 2006

(87) PCT Pub. No.: WO2005/101429

PCT Pub. Date: Oct. 27, 2005

(65) Prior Publication Data

US 2007/0134963 A1 Jun. 14, 2007

(30) Foreign Application Priority Data

Apr. 16, 2004 (DE) ..... 10 2004 019 586

(51) Int. Cl.
*H01R 4/64* (2006.01)

(52) U.S. Cl. ..... 439/190; 439/921; 439/934; 439/935

(58) Field of Classification Search ..... 439/190, 439/205, 921, 934, 935
See application file for complete search history.

(56) References Cited

U.S. PATENT DOCUMENTS

| | | | | |
|---|---|---|---|---|
| 3,440,326 | A | 4/1969 | Lair | |
| 3,515,799 | A | 6/1970 | Ristuccia et al. | |
| 6,147,333 | A | 11/2000 | Mattson | |
| 6,416,338 | B1 * | 7/2002 | Berlovan | 439/187 |
| 6,491,548 | B2 * | 12/2002 | Stepniak et al. | 439/620.28 |
| 6,585,531 | B1 * | 7/2003 | Stepniak et al. | 439/187 |
| 6,744,255 | B1 * | 6/2004 | Steinbrecher et al. | 324/511 |
| 6,843,685 | B1 * | 1/2005 | Borgstrom et al. | 439/606 |
| 6,929,492 | B2 * | 8/2005 | Bertini et al. | 439/190 |
| 2002/0164896 | A1 * | 11/2002 | Borgstrom et al. | 439/183 |
| 2007/0134963 | A1 * | 6/2007 | Janicke et al. | 439/188 |

FOREIGN PATENT DOCUMENTS

| | | |
|---|---|---|
| DE | 2003 751 | 9/1970 |
| DE | 79 522 | 11/1971 |
| DE | 27 08 323 | 8/1978 |
| DE | 44 12 761 C2 | 10/1995 |
| DE | 196 44 483 C1 | 11/1997 |
| EP | 0 971 372 A1 | 1/2000 |
| GB | 1 598 951 | 9/1981 |

* cited by examiner

*Primary Examiner*—James Harvey
(74) *Attorney, Agent, or Firm*—Laurence A. Greenberg; Werner H. Stemer; Ralph E. Locher

(57) ABSTRACT

An electrical insulator preferably for medium and high voltages surrounds an interior space. Electrically active elements can be introduced into the interior space of the electrical insulator. In order to reduce the heat transfer between the interior space and the environment of the electrical insulator, the insulator contains thermally insulating areas.

8 Claims, 3 Drawing Sheets

ELECTRICAL INSULATOR, ESPECIALLY FOR MEDIUM AND HIGH VOLTAGES

CROSS-REFERENCE TO RELATED APPLICATIONS

This is a continuing application, under 35 U.S.C. § 120, of copending international application No. PCT/DE2005/000562, filed Mar. 24, 2005, which designated the United States; this application also claims the priority, under 35 U.S.C. § 119, of German patent application No. 102004019586.2, Apr. 16, 2004; the prior applications are herewith incorporated by reference in their entirety.

BACKGROUND OF THE INVENTION

Field of the Invention

The invention relates to an electrical insulator, especially for medium and high voltages, which surrounds an interior space.

Such an insulator is known, for example, from the U.S. Pat. No. 6,147,333. The insulator therein is part of a high-voltage bushing and serves the purpose of passing electrical connecting conductors through a metallic encapsulating housing of a high-voltage power circuit breaker. An interrupter unit of the high-voltage power circuit breaker is arranged within the metallic encapsulating housing. The high-voltage bushings each have an insulator which is provided with ribbing for the purpose of extending leakage paths on its surface. The encapsulating housing is filled with an insulating gas at an elevated pressure. In order to prevent the insulating gas from being liquefied at low temperatures, the encapsulating housings of high-voltage power circuit breakers are equipped with an electrical heating device. In order to keep thermal losses as low as possible, the heating device is combined with a thermally insulating mat. In this case, it is known to arrange these mats as tightly around the encapsulating housing of the breaker as possible. The high-voltage bushings should be kept free from the insulating mats in order not to negatively influence their electrically insulating properties. Owing to the regions to be kept free, some of the heat can be emitted from the interior of the encapsulating housing to the surrounding environment via the insulators.

SUMMARY OF THE INVENTION

The invention is based on the object of developing an electrical insulator of the type mentioned at the outset such that it can be included in an improved manner in thermal insulation.

In the case of an electrical insulator of the type mentioned at the outset, the object is achieved according to the invention by the fact that the insulator has at least one thermally insulating region.

When using heating covers or insulating mats on encapsulated power circuit breakers, it is always necessary to take care that, owing to the change in the outer contour of the encapsulating housing, there is no intervention in the voltage circuits to be kept free around the high-voltage bushings. When using conventional insulating mats, only a certain degree of thermal insulation of the high-voltage power circuit breaker can therefore be ensured. Owing to the use of an electrical insulator and the introduction of at least one thermally insulating region into the insulator, the emission of heat via the electrical insulator itself can be reduced. Depending on the electrically insulating material used, for example a ceramic or a plastic, the thermally insulating region can be designed to have various shapes. For example, when producing the electrical insulator, thermally insulating elements, such as granules having gas inclusions, can be mixed into the base material. Such a refinement has the advantage that the thermally insulating effect is uniform in all subsections of the insulator. Furthermore, the mechanical stability of the electrical insulator itself is only impaired to a low extent since sufficient web widths for the electrically insulating material are available between the individual mixed-in elements. Such a refinement results in an electrical insulator which has a large number of thermally insulating regions.

Furthermore, provision may advantageously be made for the thermally insulating region to surround the interior space.

When the thermally insulating regions are arranged around the interior space, the interior space is protected particularly effectively from the emission of thermal energy through the wall of the electrical insulator. In particular when the interior space is heated, excess thermal emission can therefore be prevented. In this case, provision may be made for the interior space to be surrounded along its entire extent by the thermally insulating region or else for only sections to be surrounded by a thermally insulating region. It is thus possible to provide sections on the electrical insulator which have particularly effective thermal insulation, as required. Zones are therefore produced in a targeted manner which allow for rapid cooling and therefore have a temperature difference in comparison with the more insulated regions. It is therefore possible to encourage the production of convection in the interior space of the electrical insulator. The interior space of the insulator can be filled with various built-in components. Such built-in components are, for example, drive elements, cables and lines, etc. The insulator may also be in the form of a so-called post insulator, for example, and have assemblies in insulated fashion.

One further advantageous refinement may envisage that an electrical conductor is arranged in the interior space.

As has been described by way of introduction, the bushing arrangements on high-voltage power circuit breakers with grounded encapsulating housings represent weak points in the thermal insulation. Owing to an electrical conductor being arranged in the interior space, given a corresponding design of the insulator and the thermally insulating region it is also possible to construct a bushing arrangement. In this case, provision may advantageously be made for the insulator to be part of an electrical bushing arrangement.

It may be particularly advantageous if the insulator and the thermally insulating region are arranged coaxially with respect to the electrical conductor.

The coaxial arrangement provides advantages as regards the dielectric design of the insulator. In particular, designing the thermally insulating region as a coaxially surrounding layer makes it possible to adhere to the known design for insulators for bushings. Owing to the thermally insulating region, only the thickness of the wall of the insulator which extends around the interior space is changed. It is furthermore possible to adhere to the basic design for known bushings.

In this case, provision may advantageously furthermore be made for the thermally insulating region to be arranged as a layer between an inner tube and an outer surface layer.

In particular the design of composite insulators allows for the very simple introduction of insulating regions. In general, the composite insulators have a mechanically stabilizing element. This element may be, for example, an inner tube. The further layers for ensuring sufficient dielectric strength are then applied to this tube. Such layers are, for example, silicone layers which have a protective coating on the outer surface. It is particularly advantageous here to arrange the thermally insulating layer between the inner tube and the respective surface layer. As a result, the interior space remains free from thermally insulating sections and can be used in the usual manner. The outer surface is also retained in terms of its structure, with the result that its electrical and mechanical properties are not impaired by the insulating region. The thermally insulating region can in this case be completely sheathed by the inner tube and the outer surface layer. For this purpose, the surface layer may be in the form of a silicone protective coating, for example, which conforms to the shape of the inner tube even at the front ends of the thermally insulating layer completely around this layer. This allows for the use of various materials for the thermally insulating region since it is largely protected from external influences. It is possible, for example, to use foamed plastics such as polyurethane or other polymers. The use of insulating gases for foaming purposes in this case makes it possible for the cavities produced in the foam to be designed to be dielectrically stable. It is possible to use, for example, nitrogen or sulfur hexafluoride as the insulating gas.

Provision may furthermore advantageously be made for the thermally insulating region to be arranged between two tubes, which are positioned coaxially with respect to one another.

The use of two tubes which are positioned coaxially with respect to one another makes it possible to use the tubes themselves as the shell for the thermally insulating region. As a result, particularly simple methods can be used for introducing the thermally insulating region into the annular gap formed between the tubes. In addition, the insulating material can be selected such that the two tubes are fixed in position in relation to one another via the thermal insulation. This results in a layered body, which has a high mechanical stability owing to the tubes and a good thermal insulation capacity owing to the thermally insulating section between the tubes. Given a suitable choice of the thermally insulating material, the mechanical stability of the connected tubes can additionally be increased given a low mass. With such an arrangement, there are virtually no restrictions as regards previously used manufacturing methods for insulators. Furthermore, a fixed tubular structure is provided towards the interior space. A fixed tubular structure is likewise provided at the surface regions to be applied on the outside.

One further advantageous refinement may provide for the interior space to be filled at least partially with a fluid.

In order to increase the dielectric strength of the insulator, the interior space can be filled with an insulating gas, especially with an insulating gas at elevated pressure, such as sulfur hexafluoride or nitrogen, for example, or an electrically insulating liquid, such as an insulating oil, for example. As a result, electrically active elements arranged within the interior space, such as electrical conductors or interrupter units of switching devices, are additionally insulated.

In this case, provision may furthermore be made for field-control elements, such as multi-layer control capacitors or field-control electrodes, to also be introduced into the interior space.

In the text which follows, the invention will be shown schematically in a drawing with reference to an exemplary embodiment and will be described in more detail below.

DESCRIPTION OF THE PREFERRED EMBODIMENTS

Figure 1:
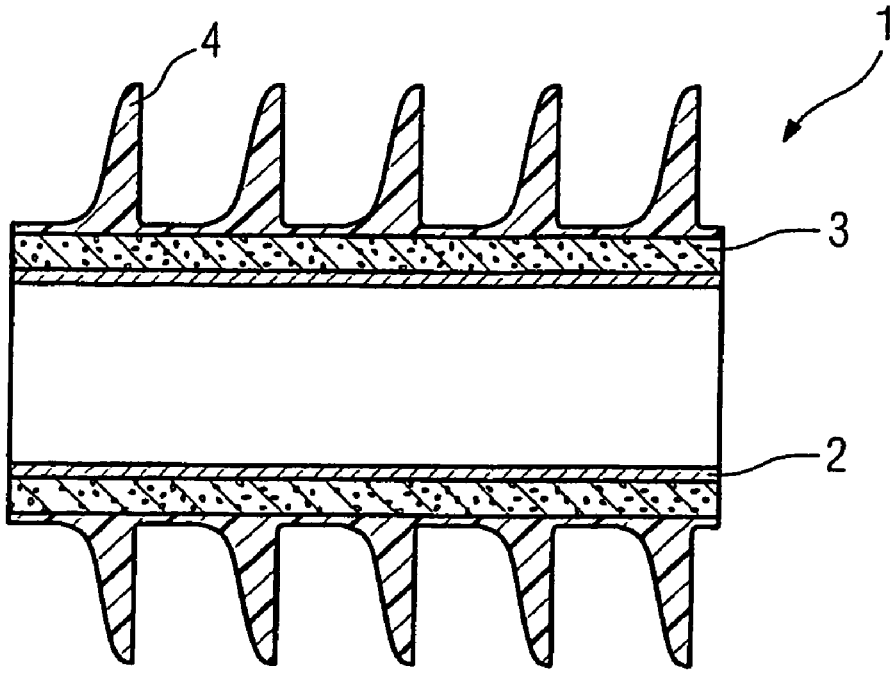
FIG. 1 shows a first design variant of an insulator.

FIG. 1 shows a section through a first design variant of an electrical insulator 1. The first design variant of the electrical insulator 1 has an essentially hollow-cylindrical structure. The first design variant of the electrical insulator 1 is in the form of a plastic composite insulator. A layer of a thermally insulating material 3 is applied to a support tube 2. The thermally insulating material 3 forms a thermally insulating region, which runs on the outside around the support tube 2. The thermally insulating region is in the form of a continuous layer. A protective coating 4 of silicone is applied as an outer surface layer to the thermally insulating material 3. This protective coating may be, for example, cast on or sprayed on or pushed on as a finished element onto the support tube 2 coated with the thermally insulating material 3. Gas inclusions contained in the insulating material 3 may be filled, for example, with an insulating gas. As a result, the dielectric stability of the insulating material 3 is improved. The thermally insulating material 3 is arranged between the inner support tube 2 and the outer protective coating 4. The outer protective coating 4 forms the outer surface layer.

Figure 2:
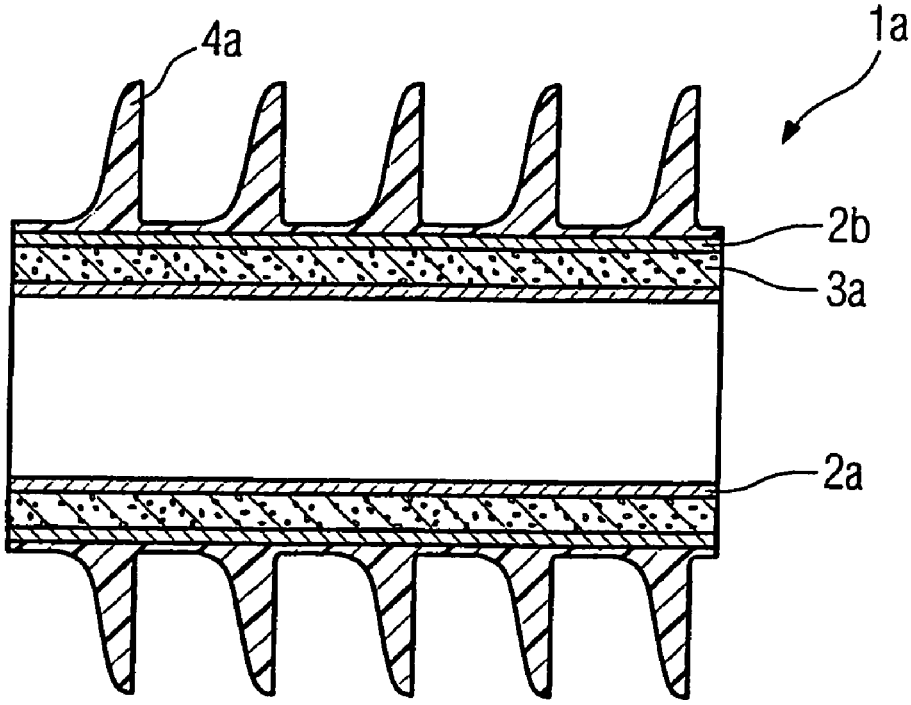
FIG. 2 shows a second design variant of an insulator.

FIG. 2 shows a second design variant of an electrical insulator 1*a*. The electrical insulator 1*a* has an essentially hollow-cylindrical design. A thermally insulating material 3*a* is arranged between a first support tube 2*a* and a second support tube 2*b*. The thermally insulating region formed by the thermally insulating material 3*a* connects the two support tubes 2*a*, 2*b* to one another. A protective coating 4*a* of silicone is applied to the second support tube 2*b*, which is positioned coaxially with respect to the first support tube 2*a*. The thermally insulating region is positioned between the inner first support tube 2*a* and the outer surface layer in the form of the protective coating 4*a*.

Figure 3:
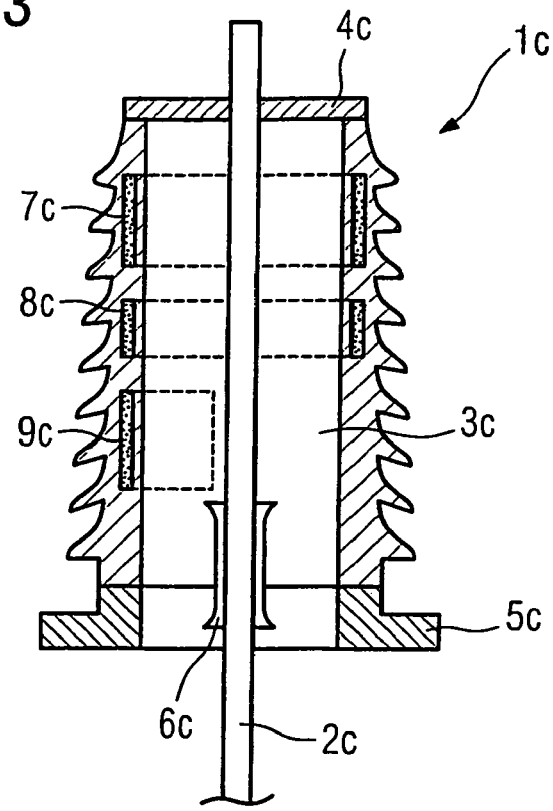
FIG. 3 shows a third design variant of an insulator for a bushing arrangement.

FIG. 3 illustrates a third design variant of an electrical insulator 1*c* when used in a high-voltage bushing arrangement. The electrical insulator 1*c* is essentially hollow-cylindrical and has an interior space 3*c*. As a deviation from this, for example, barrel-shaped or conically tapering shapes for electrical insulators can also be used. An electrical conductor 2*c* is arranged in the interior space 3*c* coaxially with respect to the electrical insulator 1*c*. At the front end, the electrical insulator 1*c* is provided with a first and a second terminating fitting 4*c*, 5*c*. The electrical insulator 1*c* can be formed, for example, from a ceramic material. In order to control the electrical field, the bushing arrangement with the electrical insulator 1*c* has a field-control electrode 6*c*. The bushing arrangement in FIG. 3 can be flange-connected to a high-voltage power circuit breaker or a transformer, for example, by means of the second connecting fitting 5*c*. The interior space 3*c* can be connected to an interior space of the high-voltage power circuit breaker or the transformer and filled with a fluid, for example an insulating gas or an insulating oil. The interior space 3*c* can also be heated via this fluid compound. In order to restrict the emission of heat from the interior space 3*c*, a first, a second and a third thermally insulating region 7*c*, 8*c*, 9*c* are introduced into the electrical insulator 1*c*. In the present exemplary embodiment, the thermally insulating regions 7*c*, 8*c*, 9*c* are each completely surrounded by the, for example, ceramic base material of the electrical insulator 1*c* and embedded in the wall of the electrical insulator 1*c*. Furthermore, provision may also be made, for example, for thermally insulating regions to be introduced into cutouts in an insulator base body (for example by foaming-in a polymer). The first and the second thermally insulating regions 7*c*, 8*c* are each in the form of coaxially surrounding rings with different ring widths. The third thermally insulating region 9*c* is merely formed as a section of a circular ring. This makes it possible to adjust the thermal emission response of the bushing arrangement in a targeted manner. It is thus possible, for example, for an increased thermal emission to be desired at some regions of the electrical insulator in order to heat adjacent assemblies, for example.

Figure 4:
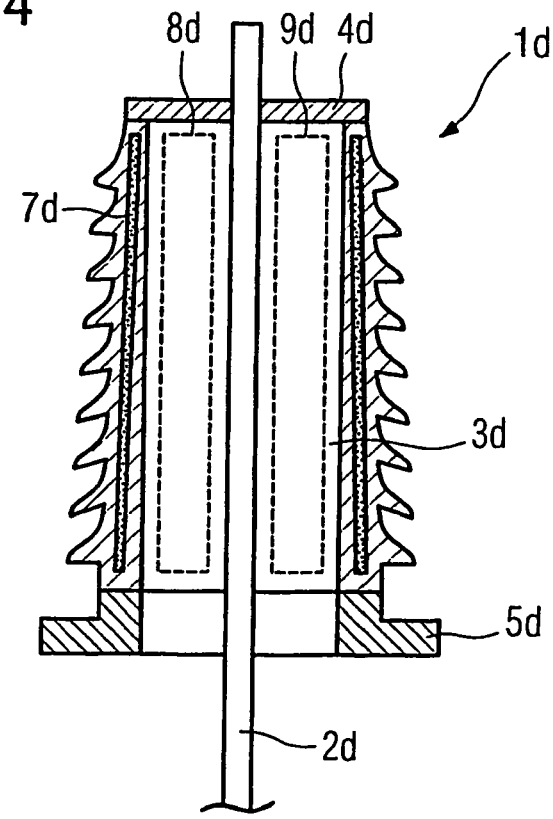
FIG. 4 shows a fourth design variant of an insulator for a bushing arrangement.

FIG. 4 shows a fourth variant of an electrical insulator 1*d*. Its design is equivalent to the bushing arrangement illustrated in FIG. 3. Only the thermally insulating regions have an alternative design. The electrical insulator id is equipped with rod-shaped or elongate plate-shaped thermally insulating regions 7*d*, 8*d*, 9*d*. The thermally insulating regions are each in the form of curved rectangular or trapezoidal plates. In this case provision may be made for the plates to have a smaller wall thickness in the region of the first connecting fitting 4*d* than in the region of the second connecting fitting 5*d* (and vice versa).

Functionally identical elements in FIG. 4 are provided with the corresponding reference symbols from FIG. 3, the only difference being the respective alphabetical indices.

Figure 5:
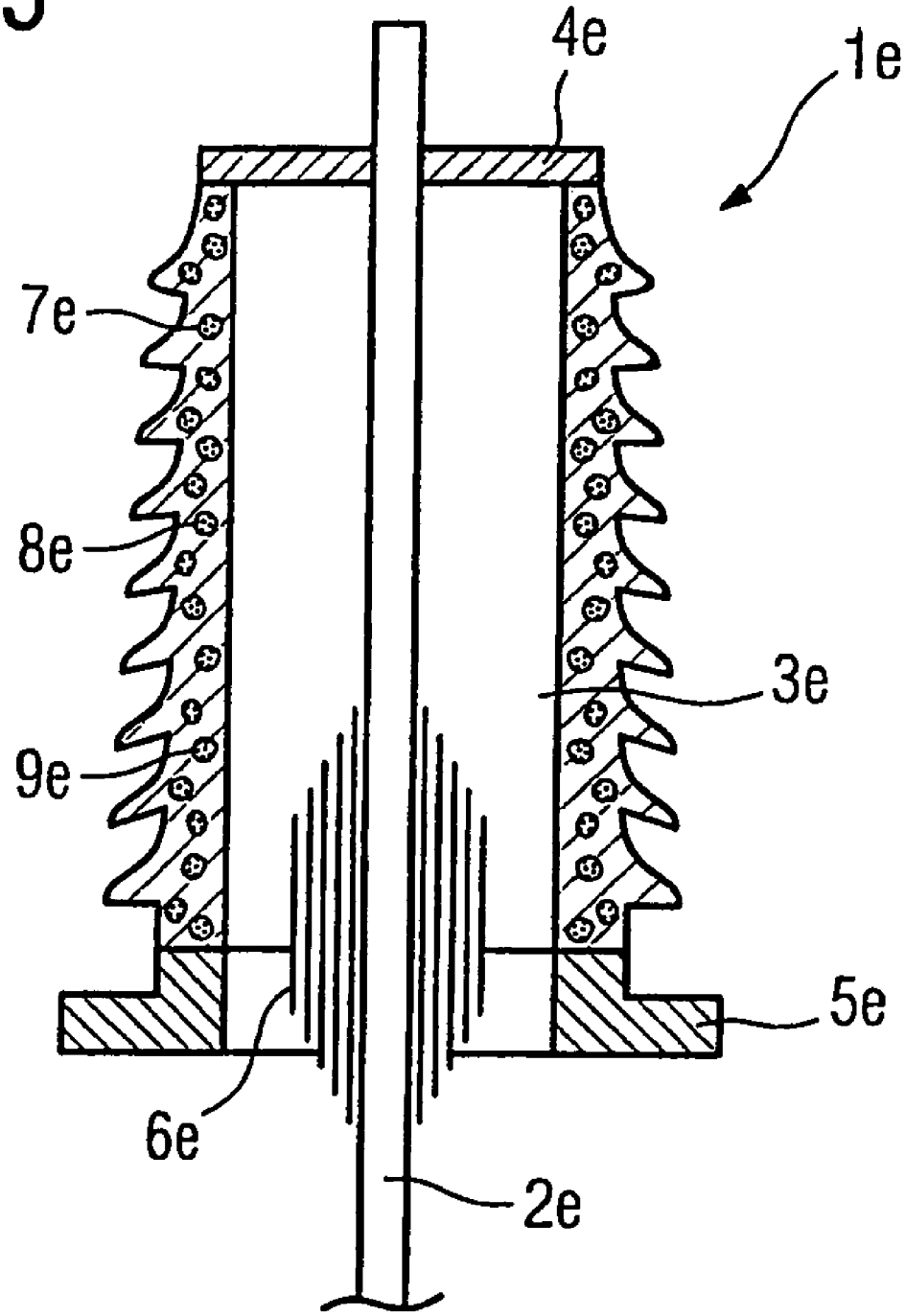
FIG. 5 shows a fifth variant of an insulator for a bushing arrangement.

FIG. 5 shows a fifth design variant of an electrical insulator 1*e*. In accordance with the basic design, the bushing arrangement with the electrical insulator 1*c* corresponds to the bushing arrangement shown in FIG. 5. Functionally identical constituent parts are therefore provided with the same reference symbols, the only difference being the alphabetical indices. A large number of thermally insulating regions 7*e*, 8*e*, 9*e* are included in the electrical insulator 1*e*. The thermally insulating regions are, for example, mixed into the still shapeless basic composition as granules during manufacture of the electrical insulator 1*e*. An intrinsically homogeneous structure of the electrical insulator id thus results, a uniform distribution of the thermally insulating regions 7*e*, 8*e*, 9*e* being produced in all sections, and the thermally insulating regions 7*e*, 8*e*, 9*e* surrounding the interior space. Furthermore, the bushing arrangement illustrated in FIG. 5 is designed to have a multi-layer capacitor element 6*e* for the purpose of controlling the electrical field distribution.

The insulators illustrated in FIGS. 1 to 5 can each be used in bushing arrangements or as a post insulator for holding assemblies in an electrically insulated manner.

Over and above the design variants illustrated in the figures for the arrangement of a thermally insulating material in an electrical insulator, further design variants of thermally insulating regions on the insulator can also be provided. For example, a thermally insulating fiber string can be wound in helical fashion, and a fixed electrical insulator can be formed whilst adding a corresponding mechanically stabilizing material, for example a resin, which insulator has thermally insulating regions in its wall and makes available an interior space within which electrically active elements can be arranged.

We claim:

1. An electrical insulator, comprising:

an electrical insulating body defining and surrounding an interior space, said electrical insulating body having at least one thermally insulating region and an outer surface layer encasing said thermally insulating region; and an electrically insulating fluid at least partially filling said interior space;

said electrical insulating body including a non-conductive inner tube; and said thermally insulating region being disposed as a layer between said inner tube and said outer surface layer.

2. The insulator according to claim 1, wherein said thermally insulating region surrounds said interior space.

3. The insulator according to claim 1, further comprising an electrical conductor disposed in said interior space.

4. The insulator according to claim 1, wherein the insulator is part of an electrical bushing configuration.

5. The insulator according to claim 3, wherein said electrical insulating body and said thermally insulating region are disposed coaxially with respect to said electrical conductor.

6. The insulator according to claim 1, wherein said electrical insulating body includes two tubes positioned coaxially with respect to one another, and said thermally insulating region is disposed between said two tubes.

7. The insulator according to claim 1, wherein said insulating region contains a material having foamed gas inclusions.

8. The insulator according to claim 1, where the insulator is configured for medium and high voltages.

* * * * *